United States Patent [19]

Kaufman

[11] Patent Number: 4,860,893

[45] Date of Patent: Aug. 29, 1989

[54] PAPER ROLL COVER AND PROCESS FOR MANUFACTURE

[76] Inventor: Kevin W. Kaufman, 301 Hollowood Dr., West Lafayette, Ind. 47906

[21] Appl. No.: 135,833

[22] Filed: Dec. 21, 1987

[51] Int. Cl.[4] ..... B65D 85/60

[52] U.S. Cl. ..... 200/390; 206/397; 206/408; 206/410; 206/610; 206/632

[58] Field of Search ..... 206/610, 618, 632, 390, 206/389, 397, 408, 410

[56] References Cited

U.S. PATENT DOCUMENTS

| | | | |
|---|---|---|---|
| 1,255,772 | 2/1918 | Miller . | |
| 1,523,297 | 1/1925 | Savery . | |
| 1,905,561 | 4/1933 | Gluck . | |
| 3,319,870 | 1/1967 | Haider et al. . | |
| 4,101,026 | 7/1978 | Bonk . | |
| 4,312,384 | 1/1982 | Becker et al. . | |
| 4,570,820 | 2/1986 | Murphy | 206/610 |

FOREIGN PATENT DOCUMENTS

WO87/02646 8/1986 World Int. Prop. O. .

OTHER PUBLICATIONS

Copy of Designer Bounty Wrapper, Proctor and Gamble Company of Cincinnati, OH, Showing circumferential perforations. 2 pages.

Copy of Kleenex brand Pocket Pack Tissues by Kimberley-Clark Corporation of Neena, Wisconsin showing Perforations, 1 page.

Copy of Ruffies Trash & Grass Bags by Poly-Tech, Inc., of Minneapolis, Minnesota Includes Packaging for Dispensing Trash and Grass Bags, 2 pages.

*Primary Examiner*—Joseph Man-Fu Moy

*Attorney, Agent, or Firm*—Woodard, Emhardt, Naughton Moriarty & McNett

[57] ABSTRACT

A roll paper cover and process for making the same. The roll paper cover includes a flexible plastic cover for the roll of paper towel and a longitudinal dispensing opening therein for dispensing sheets of paper. The paper roll cover may comprise a thin, partially clear plastic sheet, heat sealed around a paper roll and having a longitudinal series of perforations therein to be torn open to define a dispensing opening. Circumferential perforation segments may be provided to enlarge the dispensing opening and provide a flap. An alternative embodiment may include elastic means for radially collapsing the cover upon dispensing of the roll. Furthermore, a closure, such as Velcro, may be provided for a flap covering the dispensing opening. Various processes for making the claimed device may be employed, including heat sealing plastic around the top and bottom ends of the roll of paper, and scoring a longitudinal series of perforations therein.

7 Claims, 4 Drawing Sheets

PAPER ROLL COVER AND PROCESS FOR MANUFACTURE

BACKGROUND OF THE INVENTION

This invention relates generally to rolled paper products, such as paper toweling, and more specifically to a cover structure around a roll of paper suitable for dispensing sheets of the paper.

It is desirable in certain situations to have paper rolled products, such as paper toweling or toilet paper, portable and available for convenient dispensing. For example, persons needing to take paper towels with them in an automobile would have use for a portable cover for the paper towel which prevented it from unraveling, yet allowed for convenient dispensing of paper towel sheets. Another example arises with campers' need to bring paper products, such as toilet paper, along with them on a camping trip. It is desirable to have such toweling wrapped in a waterproof or water repellent container, while allowing convenient dispensing thereof. It is preferable to have such container being flexible in order that it may more resiliently withstand the jostles, compaction and general abuse that can be associated with items packed for trips. Furthermore, in certain applications, it is preferable, although not mandatory, that such dispensing cover be provided as inexpensively as possible and without excessive capital investment on the part of roll paper manufacturers.

Several cover products and covering processes have been developed in conjunction with the roll paper products. U.S. Pat. No. 1,255,772 to Miller and U.S. Pat. No. 1,523,297 to Savery each disclose rigid casing containers for dispensing paper towels from a longitudinal slot in the casing. Both of these devices feature detergent container/dispensers disposed centrally in the core of the roll paper. While providing the advantage of a portable towel dispenser, these products are generally rigid in construction and consequently do not offer the soft compressibility useful in packing of the present invention. U.S. Pat. No. 1,905,561 to Gluck discloses a box for dispensing rolled products, such as wax paper, including a cutting edge for separating sheets of the wax paper. Such box is typically made of cardboard and is relatively stiff. The serrations are useful for cutting paper products which, unlike paper towels and toilet paper, do not have pre-cut sheet sections. U.S. Pat. No. 4,101,026 to Bonk discloses a pre-moistened towelette dispenser. An outer housing holds an inner liner for moisture containment. U.S. Pat. No. 3,319,870 to Haider discloses a protective sheath for rolled sheet material and a process of manufacture thereof. U.S. Pat. No. 4,312,384 to Becker discloses a support sheath of formable material used in the production of sausages.

It is well-known that paper towels are offered by many manufacturers wrapped in clear plastic flexible sheets which are heat fused at the top and bottom ends and along a longitudinal seam. A product registered under the trademark Designer "Bounty", offered by the Procter and Gamble Company of Cincinnati, OH, is one such product and further includes circumferential perforations in the sheet plastic cover about one inch below the top end of the roll. Such perforations aid the user in destructively tearing off the plastic cover from the roll of "Bounty" brand paper. Another product is the Kleenex® brand Pocket Pack tissues offered by the Kimberley-Clark Corporation of Neena, Wisconsin. This pocket pack is a rectangular package of 15 two-ply facial tissues in which a series of perforations are scored on one face of the rectangular package, with such perforations terminating about one inch from each edge of such face. Individual stacked tissues are removed from the top of the stack through the opening formed when the user tears open the perforations.

Finally, a product marketed as Ruffies® trash & grass bags by Poly-Tech, Inc., of Minneapolis, Minnesota, includes packaging for dispensing trash and grass bags. Such package includes a partially clear plastic bag having one end that is not heat sealed in which a coreless roll of trash bags is disposed. The end of the container bag that is not heat sealed is cinched closed by a tape wrapped around the container bag. The container bag includes an oblong, oval-shaped tab defined by perforations scored in the container bag. Upon removal of the tab, the trash bags contained in the container bag may be dispensed through the dispenser opening formed by removal of the oval tab. The dispenser opening is about one and a half inches shorter than the width of the rolled trash bags to be dispensed.

While the various devices each address certain problems, none of them provide all the advantages of the present invention. In one embodiment, the present invention is created by scoring a series of perforations longitudinally in a plastic paper towel roll cover generally parallel with the longitudinal core axis of the roll. Such improvement allows for convenient dispensing from the plastic cover without destructive removal of the cover presently experienced by use of the circumferential perforations. Furthermore, this advantage may be realized without major modification to existing manufacturing techniques used in packaging paper towel and/or toilet paper products, providing an improved product without undue expense.

Furthermore, an alternative embodiment of the present invention is a reusable cover having greater durability than conventionally wrapped paper towel cover plastics. However, such device would still preferably be flexible, facilitating its use in "soft luggage" which is popular for travel.

SUMMARY OF THE INVENTION

According to one embodiment, the present invention provides a packaging process comprising the steps of scoring a series of perforations along a first longitudinal direction in a sheet of flexible plastic having a less than and about 0.05 of an inch; wrapping the sheet of plastic around a roll of absorbent paper, the roll having a core therein and with a top end and a bottom end, wherein the series of perforations is generally parallel to the core of the roll of paper, and wherein the series of perforations is adapted to be torn to define a longitudinal dispensing opening for dispensing sheets of paper from the roll; heat sealing a first portion of the sheet of plastic around the top end of the roll of paper; and heat sealing a second portion of the sheet of plastic around the bottom end of the roll of paper.

According to another embodiment, the present invention also provides a paper roll cover for rolled paper products, comprising: a roll of dry absorbent paper towels having a longitudinal core, the roll having a top end and a bottom end; and a flexible plastic cover wrapped around the roll and heat sealed over the top end and the bottom end; and a longitudinal series of perforations in the cover extending the length of the roll from the top end to the bottom end, wherein the series of perforations is adapted to be torn to define a longitudinal dispensing opening for dispensing sheets of paper from the roll.

The present invention also provides a holder for a roll of absorbent paper with a longitudinal core comprising a tubular portion made of flexible plastic, the tubular portion having a longitudinal slit means for defining a dispensing opening in the tubular portion; a flexible plastic flap covering the opening, the flap being integrally formed from the tubular portion; a top portion made of flexible plastic and integrally formed with the tubular portion; and a bottom portion made of flexible plastic and integrally formed with the tubular portion, wherein the top portion and the tubular portion and the bottom portion collectively provide a cover for the roll of paper.

An object of the present invention is to provide an improved paper roll cover.

Another object of the present invention is to provide an improved process for packaging paper roll products.

Another object of the present invention is to provide a paper roll cover which is portable and convenient for dispensing sheets of paper.

Another object of the present invention is to provide a paper roll dispenser which is flexible and compressible for packing.

Related objects of the present invention are disclosed in the following description of the preferred embodiments.

DESCRIPTION OF THE PREFERRED EMBODIMENTS

Figure 1:
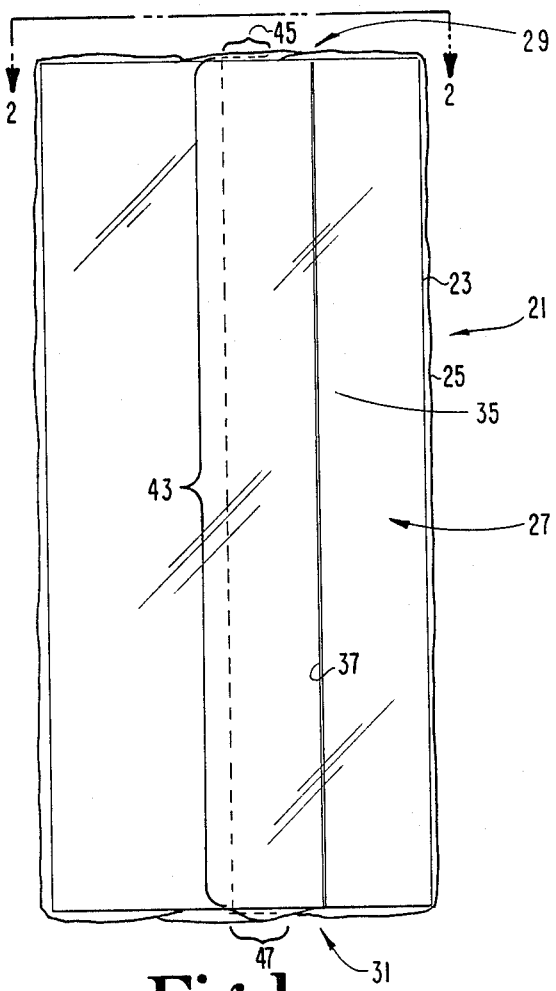
FIG. 1 is a side elevational view of a first preferred embodiment of the paper roll cover of the present invention.

For the purposes of promoting an understanding of the principles of the invention, reference will now be made to the embodiments and processes illustrated in the drawings and specific language will be used to describe the same. It will nevertheless be understood that no limitation of the scope of the invention is thereby intended, such alterations and further modifications in the illustrated devices and processes, and such further applications of the principles of the invention as illustrated therein being contemplated as would normally occur to one skilled in the art to which the invention relates.

Figure 3:
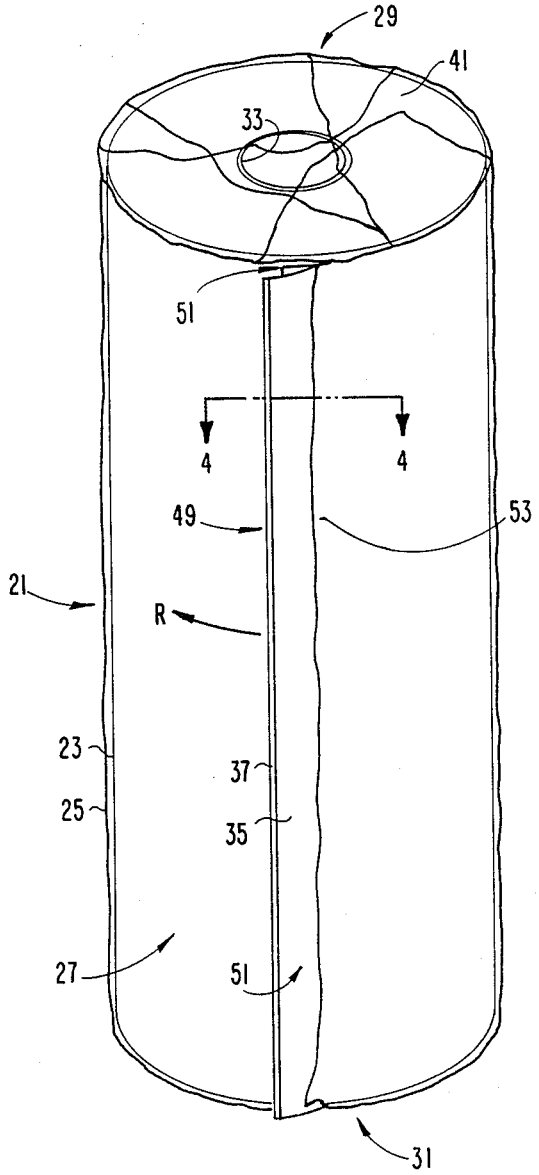
FIG. 3 is a perspective view of a the paper roll cover of FIG. 1 in which the cover has been opened for dispensing the paper product.
Figure 2:
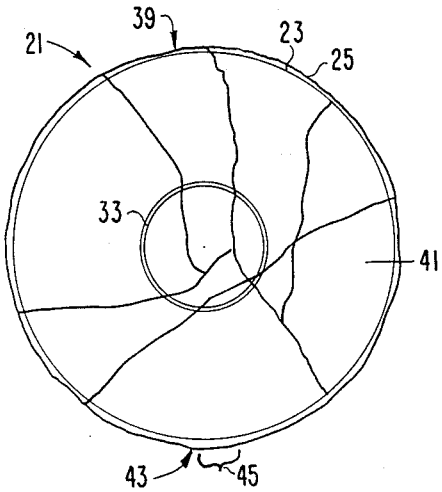
FIG. 2 is a top plan view of the paper roll cover of FIG. 1 taken along line 2—2 in FIG. 1.

Referring now to FIGS. 1–4, wrapped paper roll 21 includes a conventional paper roll 23 and clear plastic outer cover 25. Geometrically, paper roll 23 has a cylindrical side 27 (half of which is shown in FIG. 1), top end 29 (shown in FIG. 2), and bottom end 31, which is substantially identical to top end 29 in appearance. Paper roll 23 has a conventional central longitudinal core 33, typically made of cardboard or other suitable material. Core 33 defines a longitudinal axis in the center thereof which acts as the axis of rotation when sheets of paper are removed from paper roll 23. Paper roll 23 has an end sheet of paper 35, which has a leading edge 37. As is known, end sheet 35 is the outermost sheet of paper on roll 23 and accordingly is the first to be removed from roll 23. Clear plastic outer cover 25 is conventionally heat fused around top end 29 and bottom end 31 as well as being heat fused at longitudinal seam 39 (see FIG. 2) as is known. Seam 39 is formed by heat fusing a first free end of sheet plastic to a second free end of the same sheet of plastic to form a cylinder wrapped around the roll of paper (see FIG. 6, roll $D_6$; FIG. 7, roll $E_7$). FIGS. 2 and 3 illustrate tucks and creases in the plastic cover 25 on the top end 29 of the wrapped paper roll 21. In the present invention, it is preferable that the rolled layers 41 of paper making up paper roll 23 be relatively tightly wound with respect to each other and with respect to core 33. Furthermore, it is preferable that clear plastic outer cover 25 be relatively loosely wrapped around paper roll 23 in the present invention.

In the preferred embodiment of the present invention, clear plastic outer cover 25 has a longitudinal series of perforations 43 cut in the cylindrical side 27 of clear plastic outer cover 25. This series of perforations 43 (see FIG. 1) is generally parallel to the longitudinal axis defined by core 33. Preferably, the series of perforations 43 is generally linear and extends a series length about equal to or slightly greater than the width of end sheet 35 of paper roll 23. It is possible, although not necessary, to the present invention to include a top perforation segment 45 and a bottom perforation segment 47 (see FIG. 1). This pair of perforation segments 45 and 47 each intersect with longitudinal series of perforations 43 near the top end and bottom end of perforation series 43 respectively. These perforation segments intersect generally perpendicular to the longitudinal perforations and are generally circumferentially oriented with respect thereto inasmuch as they extend around the circular top and bottom profiles of the wrapped paper roll 21.

Figure 4:
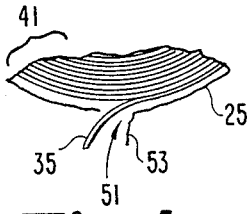
FIG. 4 is a partial cutaway top sectional detail view of the paper roll cover of FIG. 1 taken along line 4—4 in FIG. 3.

These perforations 43, 45 and 47 provide a means for the user to tear the clear plastic outer cover 25 open along perforations 43, 45 and 47 in predetermined and defined locations. After outer cover 25 has been torn open along perforation 43, perforation 45, and perforation 47, wrapped paper roll 21 may be dispensed through the longitudinal dispensing opening 51 in outer cover 25 thus created as illustrated in FIGS. 3 and 4. What was formerly a series of perforations 43, 45 and 47 becomes a longitudinal slit 49 in outer cover 25, defining dispensing opening 51. Series of perforations 43 is adapted to be torn to define longitudinal dispensing opening 51 for dispensing sheets of paper, such as sheet 35, from roll 21. Flap 53 is integrally formed with side 27 of outer cover 25, and at least partially covers dispensing opening 51 when it is allowed to lay closed over the opening. As illustrated in FIGS. 3 and 4, end sheet 35 is dispensed from dispensing opening 51 by pulling it outwardly in a direction depicted by arrow "R" (see FIG. 3). In this way, sheets of rolled paper may be dispensed from clear plastic outer cover 25 while leaving the cover generally intact. Accordingly, the paper roll is maintained with an outer cover which both keeps the paper from unraveling and provides significant protection for the paper from the environment.

Figure 5:
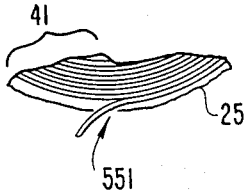
FIG. 5 is a partial cutaway top sectional detail view of a second preferred embodiment of the paper roll cover of the present invention taken from a view identical to the view of FIG. 4.

Referring to FIG. 5, there is shown an alternative preferred embodiment of the present invention. FIG. 5 shows an end view of paper roll 21 essentially identical to FIG. 4. The only difference between the outer cover 25 of FIG. 5 and FIGS. 1–4 is that the outer cover 25 of FIG. 5 does not include top perforation segment 45 or bottom perforation segment 47. Accordingly, since longitudinal series of perforations 43 provides the only perforations for defining the dispensing opening 551 of FIG. 5, there is no flexible plastic flap 53 formed as outer cover 25 is torn open along the series of perforations 43, as illustrated in FIGS. 3 and 4. Instead, dispensing opening 51 is a slit formed where previous series of perforations 43 have been torn. Thus, opening 551 is somewhat narrower than opening 51.

Preferably the plastic of outer cover 25 includes at least some clear plastic. However, opaque or translucent portions of plastic may be provided for printing the name, trademarks and decorative packaging. It is preferable to provide at least some clear plastic to facilitate the user's alignment of leading edge 37 with the dispensing opening. This need arises because in packaging, the longitudinal series of perforations 43 is not necessarily aligned with leading edge 37, requiring the user to rotate the paper roll within the plastic outer cover until alignment with the dispensing opening is achieved. Also, in the interest of material and cost savings, the plastic making up clear plastic outer cover 25 is typically very thin, being less than 0.05 inches in thickness which is typical of conventional shrink-wrap type plastics utilized in packaging paper toweling.

Figure 6:
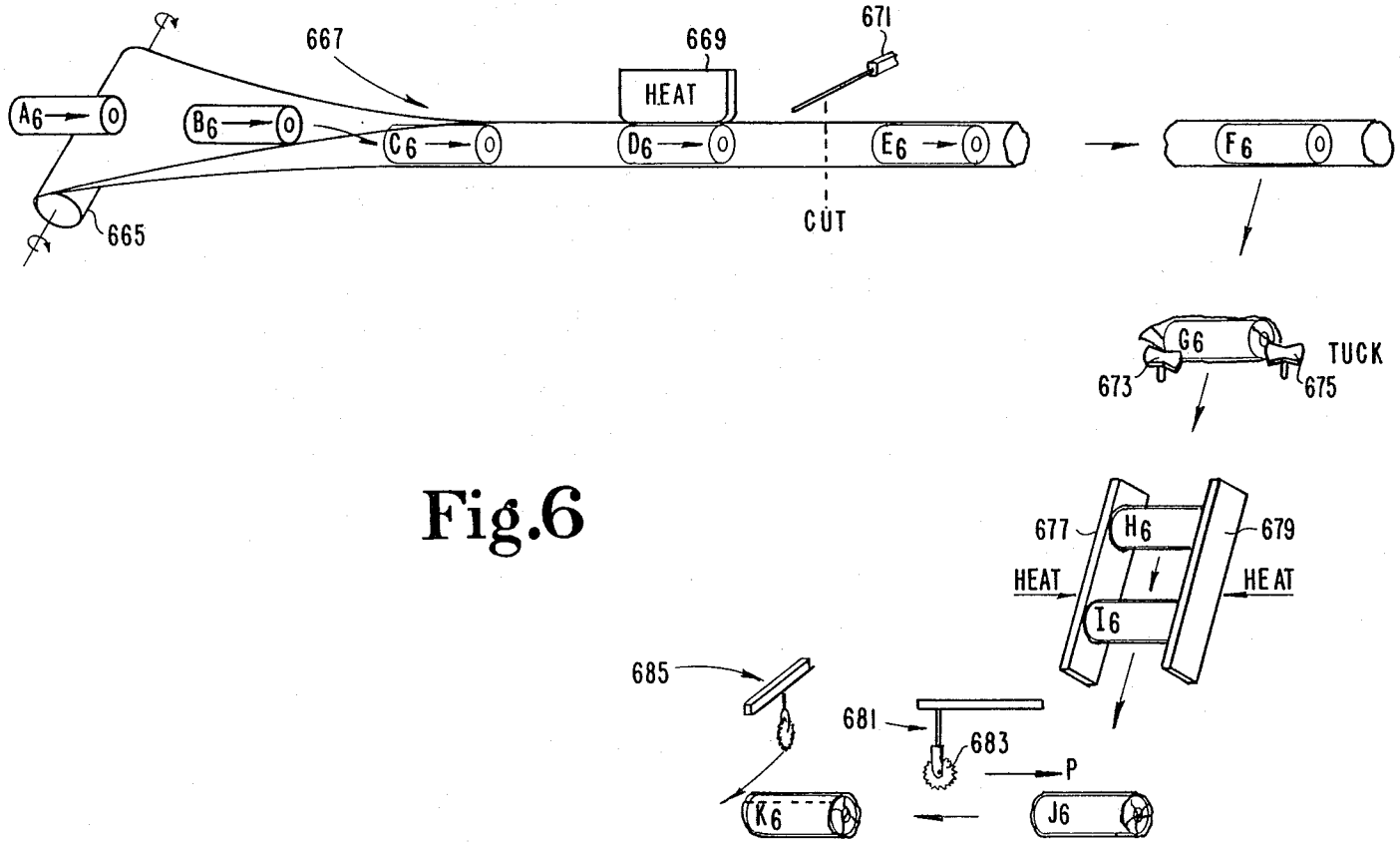
FIG. 6 is a perspective diagrammatic view of a first preferred process for manufacturing a paper roll cover of the present invention.
Figure 7:
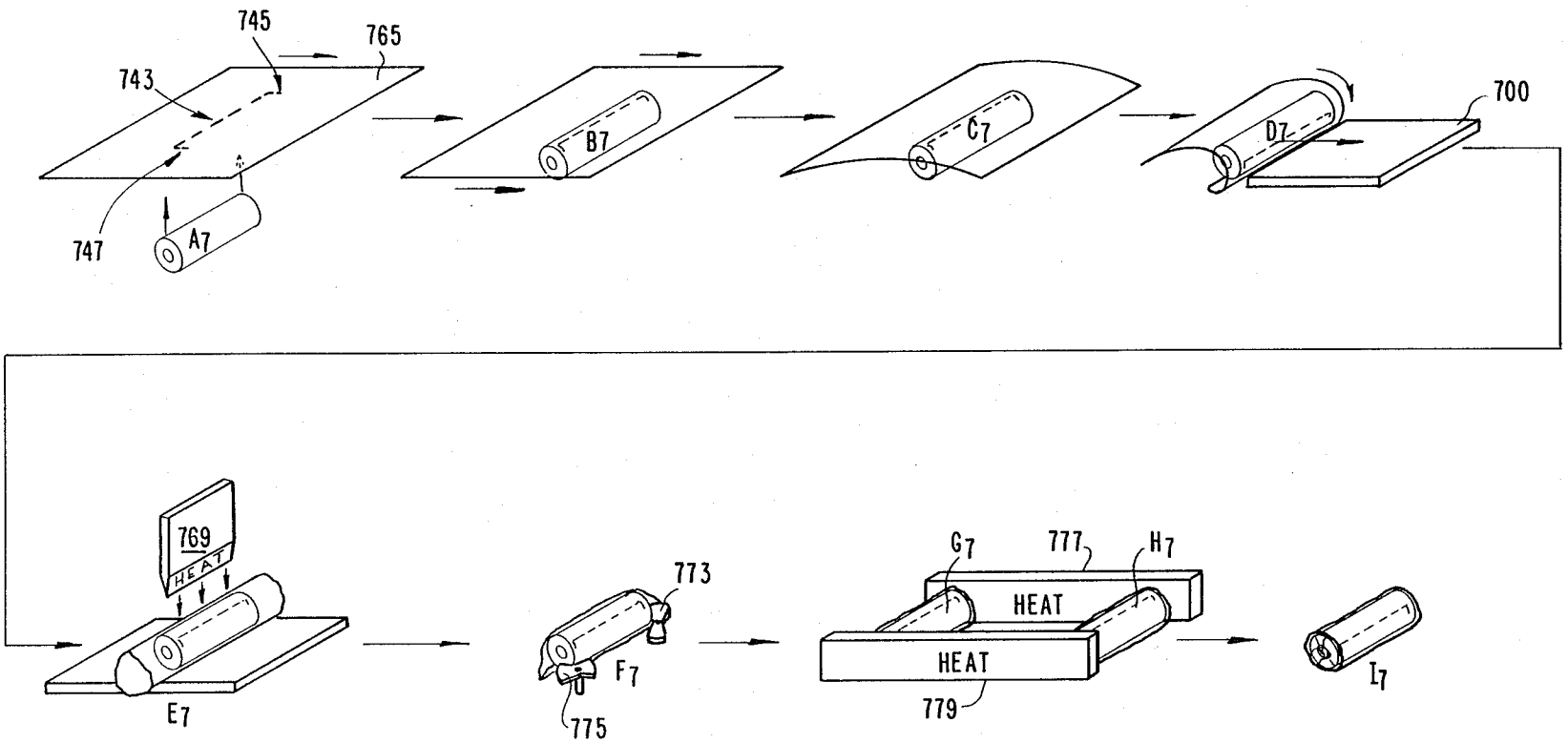
FIG. 7 is a perspective diagrammatic view of a second preferred process for making a paper roll cover of the present invention.

Referring now to FIG. 6, one process for manufacturing the wrapped paper rolls of FIGS. 1–5 is illustrated. Various stages along the process are illustrated by various rolls of paper with their associated covering, $A_6$, $B_6$, $C_6$, $D_6$, $E_6$, $F_6$, $G_6$, $H_6$, $I_6$, $J_6$ and $K_6$, in sequential order of process. A roll of at least partially clear plastic cover material 665 is unrolled dynamically to form a continuously formed tube 667 in which rolls of paper toweling (such as $A_6$, $B_6$ and $C_6$) are fed. Heater element 669 conventionally heat seals the plastic cover material along a longitudinal seam, such as longitudinal seam 39 illustrated in FIG. 2. Conventional cutting device 671 cuts tube 667 into discreet tubes of plastic cover material as illustrated with roll $F_6$. The tubular length of the clear plastic material is longer than the tubular length of the roll of paper, providing overlap at each of the top end and bottom end of the roll of paper. Cutting device 671 may be any number of conventional types of cutters, such as one using an electrical current heated wire to cut tube 667.

Next, a roll, such as roll $F_6$, is run through conventional tucking toggles 673 and 675 to tuck the overlapping portions of the plastic wrap around the top and bottom ends of the paper roll. Next, the tucked, wrapped paper roll is run through conventional heating elements 677 and 679 to heat seal the plastic wrap around the top end of the roll of paper and around the bottom end of the roll of paper (such as rolls $H_6$ and $I_6$).

Next, a longitudinal perforator, such as perforator 681, scores perforations into the plastic wrap, such as the longitudinal series of perforations 43 shown in FIG. 1. These perforations may be scored in any number of ways, but one preferred way is the use of a cutting wheel 683 which acts somewhat like a textile tracing wheel, longitudinally traversing wrapped paper roll, such as roll $J_6$. Optionally, a transverse perforator 685 similar to perforator 681 may also be provided to score transverse perforation segments, such as perforation segments 45 and 47 illustrated in FIG. 1.

These perforation steps may occur at a variety of points along the manufacturing process, but are preferably done after the paper roll is completely heat sealed and wrapped both on a longitudinal seam and at the top and bottom ends of the paper roll. Other means for scoring perforations may be employed, including using reciprocating punch dies, or having the roll of cover material plastic 65 pre-perforated at appropriate increments along its length.

Referring now to FIG. 7, an alternative preferred process for manufacturing the wrapped paper rolls of FIGS. 1–5 is illustrated. Although having steps in common with the process illustrated in FIG. 6, FIG. 7 is primarily distinct from the process illustrated in FIG. 6 in that it utilizes discreet sheets of plastic for wrapping cover material, as opposed to the dynamic tube forming process of FIG. 6. FIG. 7 illustrates in series rolls $A_7$, $B_7$, $C_7$, $D_7$, $E_7$, $F_7$, $G_7$, $H_7$ and $I_7$ in progression along the process. FIG. 7 begins by contacting a sheet of plastic cover material 765 with roll $A_7$. Note that sheet 765 is pre-perforated with a longitudinal series of perforations 743 and optional top perforation segment 745 and bottom perforation segment 747. After the sheet 765 is contacted with the roll, (such as with $B_7$), the sheet is mechanically rolled around the tubular circumference of the paper roll towel (such as rolls $C_7$ and $D_7$). As illustrated with roll $D_7$, the sheet is rolled with respect to the roll of paper towel on a surface 700. Next, as illustrated with roll $E_7$, conventional heater element 769 is lowered in contact with the sheet of plastic to heat fuse a longitudinal seam between the two free ends of the sheets of plastic. In this way, a tube of thin plastic is formed around the roll of paper with overhanging edges over the top end and bottom end of the roll of paper. Next, as illustrated with roll $F_7$, these overhanging edges of plastic are tucked with conventional tucking toggles 773 and 775, which are pivotably mounted. Next, as illustrated with rolls $G_7$ and $H_7$, conventional heating elements 777 and 779 heat seal the sheet of plastic of the plastic cover overhanging the top end and bottom end of the roll of paper, providing a heat fused portion around each of the respective top and bottom ends of the roll of paper. The finished product, such as roll $I_7$, is ready for distribution and sale, already having longitudinal, and optionally, circumferential perforation segments cut therein. Of course, it would be possible to use the process of FIG. 7 without having pre-perforations as illustrated, and instead use perforation scoring devices, such as perforator 681 and transverse perforator 685 as illustrated in FIG. 6.

Referring now to FIGS. 8–11, a third preferred embodiment 821 of the paper roll cover of the present invention is shown. This third preferred embodiment provides a reusable outer cover 825 suitable for allowing replacement of the paper roll contained therein. Wrapped paper roll 821 includes paper roll 823 surrounded by plastic outer cover 825. Outer cover 825 may be clear, or any one of a number of colors, prints, or patterns. It is preferable, although not necessary, that outer cover 825 be at least partially clear or translucent to enable the user to locate leading edge 837 of the end sheet of paper 835 to align it with dispensing opening 851 for dispensing. Paper roll 23 includes a central longitudinal core 833 therein on which the paper sheets are wrapped. The core defines a central longitudinal axis.

Figure 8:
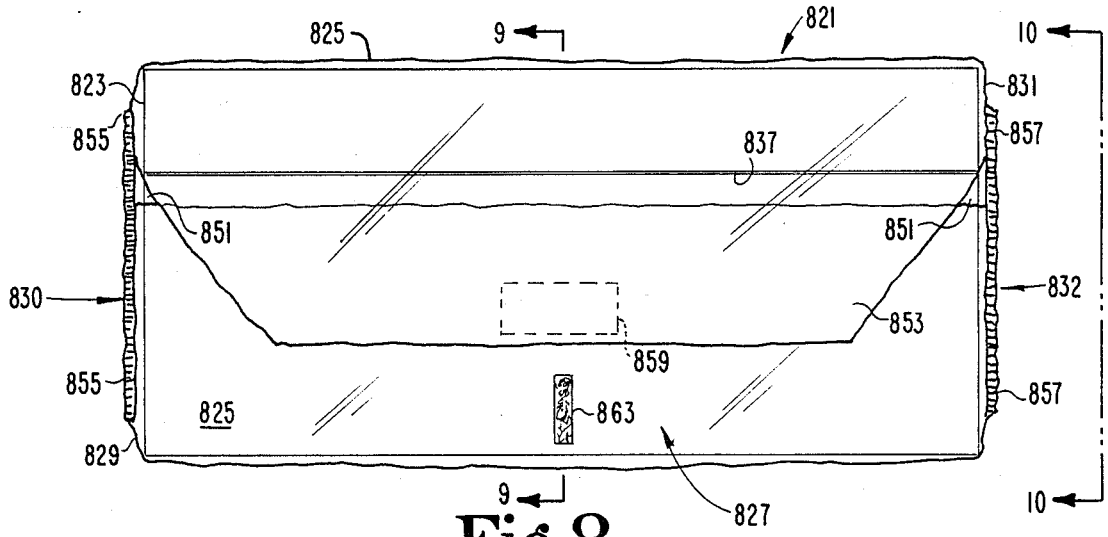
FIG. 8 is a side view of a third preferred embodiment of the paper roll cover of the present invention.
Figure 9:
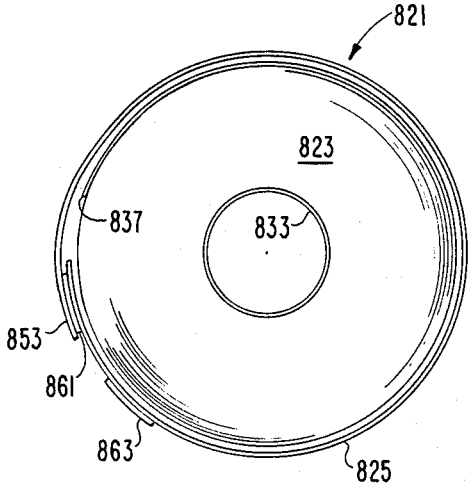
FIG. 9 is an end full section view of the paper roll cover of FIG. 8 taken along line 9—9 of FIG. 8.
Figure 10:
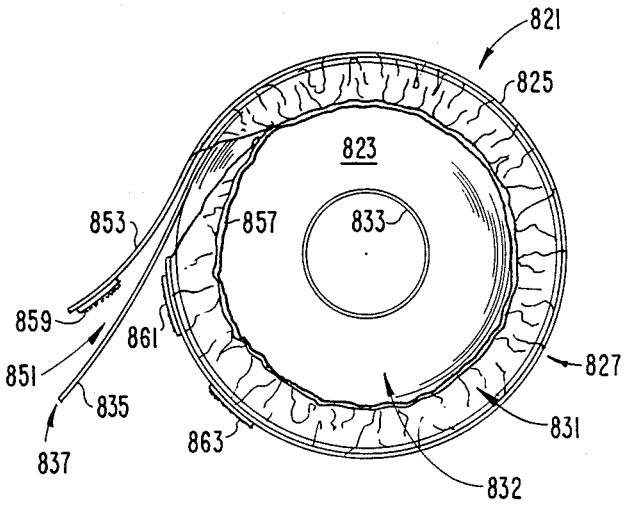
FIG. 10 is an end view of the paper roll cover of FIG. 8 showing paper product being dispensed from a new roll of paper.
Figure 11:
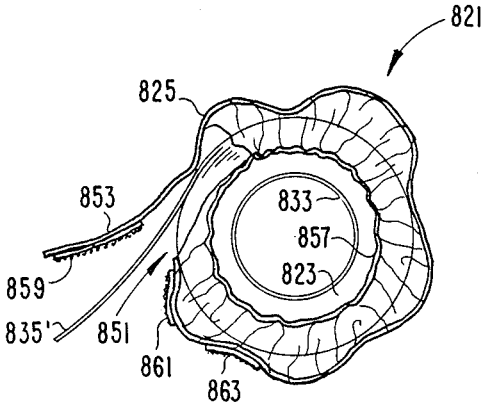
FIG. 11 is an end view of the paper roll cover of FIG. 8 showing a paper product being dispensed from a partially used roll of paper.

Plastic outer cover 825 includes a cylindrical side (or tubular portion) 827, a top end 829, and a bottom end 831 surrounding corresponding portions of the paper roll 823. Preferably, cylindrical side 827, top end 829 and bottom end 831 are all formed from an integral sheet of plastic. In the third preferred embodiment, the wrapped paper roll of FIGS. 8–11 has a central concentric opening 832 in bottom end 831 of the cover, and a central concentric opening 830 in top end 829 of the cover. In the embodiment as shown in FIGS. 8–11, these openings 830 and 832 are open, exposing the roll of paper 823 partially on its top end 829 and bottom end 831. Central concentric opening 830 and opening 832 are each defined by respective circumferential elastic members 855 and 857 as illustrated. Each of these circumferential elastic members are attached to the respective top end or bottom end of the cover and provide tensional hoop stress on the cover ends. This hoop stress provides a radially inward force towards the longitudinal axis defined by the central core 833 of the roll of paper 823. Elastic members 855 and 857 are preferably connected to top end 829 and bottom end 831 by being placed in a hem type structure formed by folding in and heat sealing the end of the plastic used to define the top and bottom ends. Accordingly, as paper towel sheets are removed from the roll 823 and it diminishes in size, elastic members 855 and 857 cause the plastic outer cover 825 to collapse down upon the roll of paper as illustrated in FIGS. 10 and 11. This functions to keep outer cover 825 relatively snug against the outermost sheets of the roll of paper 823.

Openings 830 and 832 may be expanded by stretching elastic members 855 and 857 to stretch around a new roll of paper towel. In this way, outer cover 825 may be loaded with a new roll of paper.

Outer cover 825 has a flexible plastic flap 853 integrally formed therein. Flap 853 covers dispensing opening 851 when closed as illustrated in FIGS. 8 and 9. In FIGS. 10 and 11, flap 853 is shown open, exposing dispensing opening 851 for removal of sheet 835 in FIG. 10, and sheet 835' in FIG. 11. Flap 853 includes a flap closure 859 which couples to either flap closure 861 or flap closure 863. As illustrated, flap closure 859 is made of a hook material offered under the trademark Velcro, whereas closures 861 and 863 are each made of Velcro TM loop material. Of course, flap closure 859 could be made of Velcro loop with flap closure 861 and flap closure 863 being made of Velcro hook. Furthermore, such closures may be other suitable means such as snaps, ties and the like.

To use the device of FIGS. 8–11, the operator opens flexible plastic flap 853 by separating closure 859 from closure 861. This exposes dispensing opening 851 from which end sheet of paper 835 is unrolled from paper roll 823. While pulling on sheet 835 with one hand, the user supports wrapped paper roll 821 in the palm of his opposite hand. As the roll is depleted, as illustrated in FIG. 11, flap 853 may be closed such that closure 859 engages closure 863 rather than closure 861. This allows for snug closure as plastic outer cover 825 radially contracts inward.

Plastic outer cover 825 is typically of a heavier gauge plastic than the shrink-wrap type plastic used in the wrapped paper rolls illustrated in FIGS. 1–5 to provide a tougher and more durable material suitable for reusable applications.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A holder for a roll of absorbent paper with a longitudinal core comprising:

a tubular portion made of flexible plastic, said tubular portion having a longitudinal means for defining a dispensing opening in said tubular portion;

a flexible plastic flap covering said opening, said flap being integrally formed from said tubular portion;

a top portion made of flexible plastic and integrally formed with said tubular portion; and a bottom portion made of flexible plastic and integrally formed with said tubular portion, wherein said top portion and said tubular portion and said bottom portion collectively provide a cover for the roll of paper, where said top portion includes first elastic means for radially collapsing said cover upon dispensing of the roll, and wherein said bottom portion includes second elastic means for radially collapsing said cover upon dispensing of the roll.

2. The holder of claim 1 and further comprising a closure means for holding said flap closed over said longitudinal means.

3. The holder of claim 2 wherein said closure means is a loop and hook fastener located at the longitudinal center of said longitudinal means.

4. The holder of claim 3 wherein said first elastic means defines a central concentric opening in said top end.

5. The holder of claim 1 wherein said top end has a central concentric opening therein.

6. The holder of claim 1 wherein said first means for radially collapsing includes a first circumferential elastic member and wherein said second means for radially collapsing includes a second circumferential elastic member.

7. The holder of claim 5 wherein said first means for radially collapsing includes a first circumferential elastic member and wherein said second means for radially collapsing includes a second circumferential elastic member.

* * * * *